US007625058B2

(12) United States Patent
Sakurai

(10) Patent No.: US 7,625,058 B2
(45) Date of Patent: Dec. 1, 2009

(54) IMAGE RECORDING APPARATUS AND METHOD FOR RECOVERING RECORDING HEAD

(75) Inventor: Hisaki Sakurai, Aichi-ken (JP)

(73) Assignee: Brother Kogyo Kabushiki Kaisha, Nagoya-Shi (JP)

( * ) Notice: Subject to any disclaimer, the term of this patent is extended or adjusted under 35 U.S.C. 154(b) by 226 days.

(21) Appl. No.: 11/977,298

(22) Filed: Oct. 24, 2007

(65) Prior Publication Data

US 2008/0094434 A1 Apr. 24, 2008

(30) Foreign Application Priority Data

Oct. 24, 2006 (JP) ..... 2006-288515

(51) Int. Cl.
*B41J 29/38* (2006.01)

(52) U.S. Cl. ..... 347/14; 347/19; 347/35

(58) Field of Classification Search ..... 347/14, 347/19.35

See application file for complete search history.

(56) References Cited

U.S. PATENT DOCUMENTS 7,356,285 B2 * 4/2008 Kim et al. ..... 399/167

FOREIGN PATENT DOCUMENTS

JP 2141249 5/1990
JP 2005238710 9/2005

* cited by examiner

*Primary Examiner*—Thinh H Nguyen
(74) *Attorney, Agent, or Firm*—Reed Smith LLP

(57) ABSTRACT

An image recording apparatus includes a recording head which includes nozzles, a paper feeding mechanism which feeds a recording medium to the recording head, a paper discharge mechanism which discharges the recording medium from the recording head, a detecting mechanism which detects a change occurred in the paper feeding mechanism or the paper discharge mechanism, a recovery mechanism which recovers a jetting state of the nozzles, a timer which measures a time elapsed after the recovery operation is carried out, and a controller which controls the recovery mechanism according to the elapsed time. When the recovery operation for the nozzles is necessary, an operation preceding the recording operation is detected, and the recovery operation is carried out promptly before the recording operation, thereby shortening a waiting time of a user.

13 Claims, 10 Drawing Sheets

Fig. 8

| | NUMBER OF PURGING |
|---|---|
| 5 DAYS < T ≤ 10 DAYS | ONCE |
| 10 DAYS < T ≤ 15 DAYS | TWICE |
| 15 DAYS < T | THREE TIMES |
| USER COMMAND | ONCE |

IMAGE RECORDING APPARATUS AND METHOD FOR RECOVERING RECORDING HEAD

CROSS REFERENCE TO RELATED APPLICATION

The present application claims priority from Japanese Patent Application No. 2006-288515 filed on Oct. 24, 2006, the disclosure of which is incorporated herein by reference in its entirety.

BACKGROUND OF THE INVENTION

1. Field of the Invention

The present invention relates to an image recording apparatus which includes a recording head which jets an ink from nozzles on to a recording medium, and a method for recovering a recording head.

2. Description of the Related Art

Ink-jet printing apparatuses (ink-jet printers) which perform recording by jetting an ink from nozzles, or multi-function image recording apparatuses having functions such as an ink-jet printing function, a copy function, a facsimile function, and a scanner function have been known. Furthermore, printing apparatuses (printers) or image recording apparatuses which include a recovery mechanism for recovering to improve a jetting condition of the nozzles have also been known.

The recovery mechanism includes a pump which removes thickened ink, dry ink, air bubbles and the like by discharging forcibly the ink inside a recording head to an outside, and/or a wiper which wipes off the ink adhered to a nozzle surface of the recording head. Moreover, the recovery mechanism drives the recording head irrespective of a recording operation, and jets forcibly the ink inside the recording head to the outside. Accordingly, the recovery mechanism maintains the jetting condition of the ink to be favorable. Generally, a time elapsed after the recovery operation is carried out, till the subsequent recording operation is carried out is measured, and when the elapsed time is more than a predetermined time, the recovery operation of the recording head is carried out automatically. As a matter of course, when a user needs the recovery operation, the user can command the recovery operation by a button operation irrespective of the elapsed time.

However, in such apparatus, when the predetermined time has already elapsed after carrying out the recovery operation, even when the user commands the recording operation making an attempt to record an image on the recording medium, firstly, the recovery operation is executed prior to the recording operation. Therefore, a waiting time till the recording operation is completed is increased, and in many cases this is both inconvenient and frustrating for the user.

In Japanese Patent Application Laid-open No. 2005-238710 (FIG. 4 and FIG. 6) for example, in an image forming apparatus (copier, or a multi-function device having a copy function) which scans an image of a document to record the scanned image on the recording medium, a pre-operation which is performed prior to reading the document is considered as an operation which should be performed prior to making a command for the recording operation, and, if necessary, the recovery operation is carried out before starting the recording operation.

More particularly, the recovery operation is carried out by detecting the fact that a cover of a document feed tray on which the document is placed is opened, a size of the recording medium is set, the number of recording papers is set, or the document is placed on an automatic document feeder (ADF). That is these pre-operation is considered as a trigger of the recovery operation. Accordingly, as compared to a case in which the recovery operation is carried out after a command for the recording operation is made, or in other words, after a 'COPY' button is pressed, a time from reading of the document till the completion of the recording operation can be shortened.

SUMMARY OF THE INVENTION

Incidentally, as it has been mentioned above, in recent years, multi-function devices in which, in addition to a copy function, various functions such as a facsimile function, a scanner function, and a printer function are combined, have been used as a general purpose apparatus. In a multi-function device described in Japanese Patent Application Laid-open Publication No. 2005-238710, in a case of using functions other than the copy function, it is not possible to carry out a recovery operation prior to a recording operation.

An object of the present invention is to facilitate shortening of a waiting time for a user till completion of recording, by detecting an operation prior to the recording operation, and executing promptly a recovery operation before the recording operation, when the recovery operation for the nozzles is necessary.

According to a first aspect of the present invention, there is provided an image recording apparatus which forms an image by jetting an ink onto a recording medium from nozzles, including:

a recording head which includes a nozzle surface having the nozzles formed therein, and which records the image based on a recording command by jetting the ink from the nozzles onto the recording medium;

a paper feeding mechanism which feeds the recording medium to the recording head;

a paper discharge mechanism which discharges the recording medium from the recording head;

a recovery mechanism which performs a recovery operation for recovering a jetting state of the nozzles;

a timer which measures an elapsed time elapsed after the recovery mechanism has performed the recovery operation;

a detecting mechanism which detects a change occurred in the paper feeding mechanism or the paper discharge mechanism; and a controller which controls the recovery mechanism to perform the recovery operation when the detecting mechanism detects the change and when the elapsed time measured by the timer exceeds a predetermined time.

According to the first aspect of the present invention, when the change occurred in the paper feeding mechanism or the paper discharge mechanism is detected by the detecting mechanism, and when the elapsed time measured by the timer exceeds the predetermined time, the controller controls the recovery mechanism to execute the recovery operation. In other words, when the change occurred in the paper feeding mechanism or the paper discharge mechanism is detected as a precursor for the recording operation which is commanded, and when the recovery operation is required at this time, the recovery operation is carried out immediately, before the recording operation is commanded. Accordingly, as compared to a case in which the recovery operation is carried out after the recording operation is commanded, it is possible to shorten a waiting time of a user, till the recording is completed, and to eliminate an inconvenience for the user.

In the image recording apparatus of the present invention, the paper feeding mechanism may include a paper feeding tray on which the recording medium is placed and which feeds the recording medium to the recording head, and the detecting mechanism may include a first sensor which detects a change in a position of the paper feeding tray.

In this case, the position change of the paper feeding tray is detected as a precursor for the recording operation which is commanded. When there is no desired recording medium and/or when there is a shortage of the desired recording medium which is necessary for recording, the user replaces the recording medium by shifting the paper feeding tray, or replenishes the recording medium. Consequently, by detecting the position change in a part of, or in the entire paper feeding tray as a precursor of the recording operation which is commanded, it is possible to carry out the recovery operation promptly, before the recording operation is commanded, and to shorten the waiting time till the recording is completed, of the user.

In the image recording apparatus of the present invention, the discharge mechanism may include a paper discharge tray on which the recording medium discharged from the recording head is placed, and the detecting mechanism may have a second sensor which detects a change in a position of the paper discharge tray.

In this case, the position change of the paper discharge tray is detected as a precursor for the recording operation which is commanded. The user, at the time of recording on the recording medium, for receiving the recording medium upon recording, opens and closes a lid etc. of the paper discharge tray, and/or moves the paper discharge tray, according to a structure of the paper discharge tray. In this manner, by detecting the position change of the paper discharge tray as a precursor of the recording operation which is commanded, it is possible to carry out the recovery operation promptly before the recording operation is commanded, and to shorten the waiting time till the recording is completed, of the user.

In the image recording apparatus of the present invention, the controller may control the recovery mechanism such that the recovery mechanism performs the recovery operation once when the elapsed time is more than five days but not more than 10 days, that the recovery mechanism performs the recovery operation twice when the elapsed time is more than 10 days but not more than 15 days, and that the recovery mechanism performs the recovery operation three times when the elapsed time is more than 15 days.

In this case, the degree of the recovery operation is changes according to the length of the elapsed time measured by the timer. Accordingly, when the elapsed time is short, no superfluous ink is consumed at the recovery operation, and when the elapsed time is long, it is possible to facilitate sufficiently the recovery of the recording head.

The image recording apparatus of the present invention, may further include a reading mechanism which reads a predetermined image formed on an original document. In this case, even in a case of a multi-function device provided with a scanner function and a copy function, it is possible to carry out the recovery operation promptly, before the recording operation is commanded, and to shorten the waiting time till the recording is completed, of the user.

The image recording apparatus of the present invention may further include a storage-medium reading mechanism which reads data from a storage medium in which, predetermined data is stored. In this case, even when a so-called direct printing is carried out, in which image data is read directly from a storage medium such as a semiconductor memory in which image data of a picture is recorded, and the printing is carried out not via a personal computer, it is possible to carry out the recovery operation promptly, before the recording operation is commanded, and to shorten the waiting time till the recording is completed, of the user.

In the image recording apparatus of the present invention, the recovery mechanism may have a cap which covers the nozzle surface, a pump which is connected to the cap and which decompresses a space defined by the cap and the nozzle surface, and a wiper which wipes the nozzle surface. In this case, since the recovery mechanism has the cap and the pump, it is possible to carry out purging, and to maintain an ink-jetting state (condition) of the recording medium to be favorable by removing a thickened ink and air bubbles in the nozzle. Moreover, since the recovery mechanism has the wiper, it is possible to wipe off the nozzle surface, and to maintain the nozzle surface in a favorable state by removing a dry ink etc. which is adhered to the nozzle surface.

According to a second aspect of the present invention, there is provided a method for recovering a recording head of an image recording apparatus which includes the recording head, a paper feeding mechanism which feeds a recording medium to the recording head and a paper discharge mechanism which discharges the recording medium from the recording head, the method including:

measuring an elapsed time elapsed after the recording head has been recovered;

detecting a change occurred in the paper feeding mechanism or the paper discharge mechanism; and recovering the recording head when the change is detected and when the elapsed time exceeds a predetermined time.

According to the second aspect of the present invention, when the change occurred in the paper feeding mechanism or the paper discharge mechanism is detected as a precursor for the recording operation which is commanded, and when the recovery operation is required at this time, the recovery operation is carried out immediately, before the recording operation is commanded. Accordingly, as compared to a case in which the recovery operation is carried out after the recording operation is commanded, it is possible to shorten a waiting time of a user, till the recording is completed, and to eliminate an inconvenience for the user.

BRIEF DESCRIPTION OF THE DRAWINGS

FIG. 8 is a diagram showing a table stored in a ROM;

DETAILED DESCRIPTION OF THE PREFERRED EMBODIMENTS

An embodiment of an image recording apparatus of the present invention will be described below. In the embodiment, the present invention is applied to a multi-function device (MFD) 1 which has a multi-function such as a printer function, a copy function, a scanner function, and a facsimile function.

Figure 7:
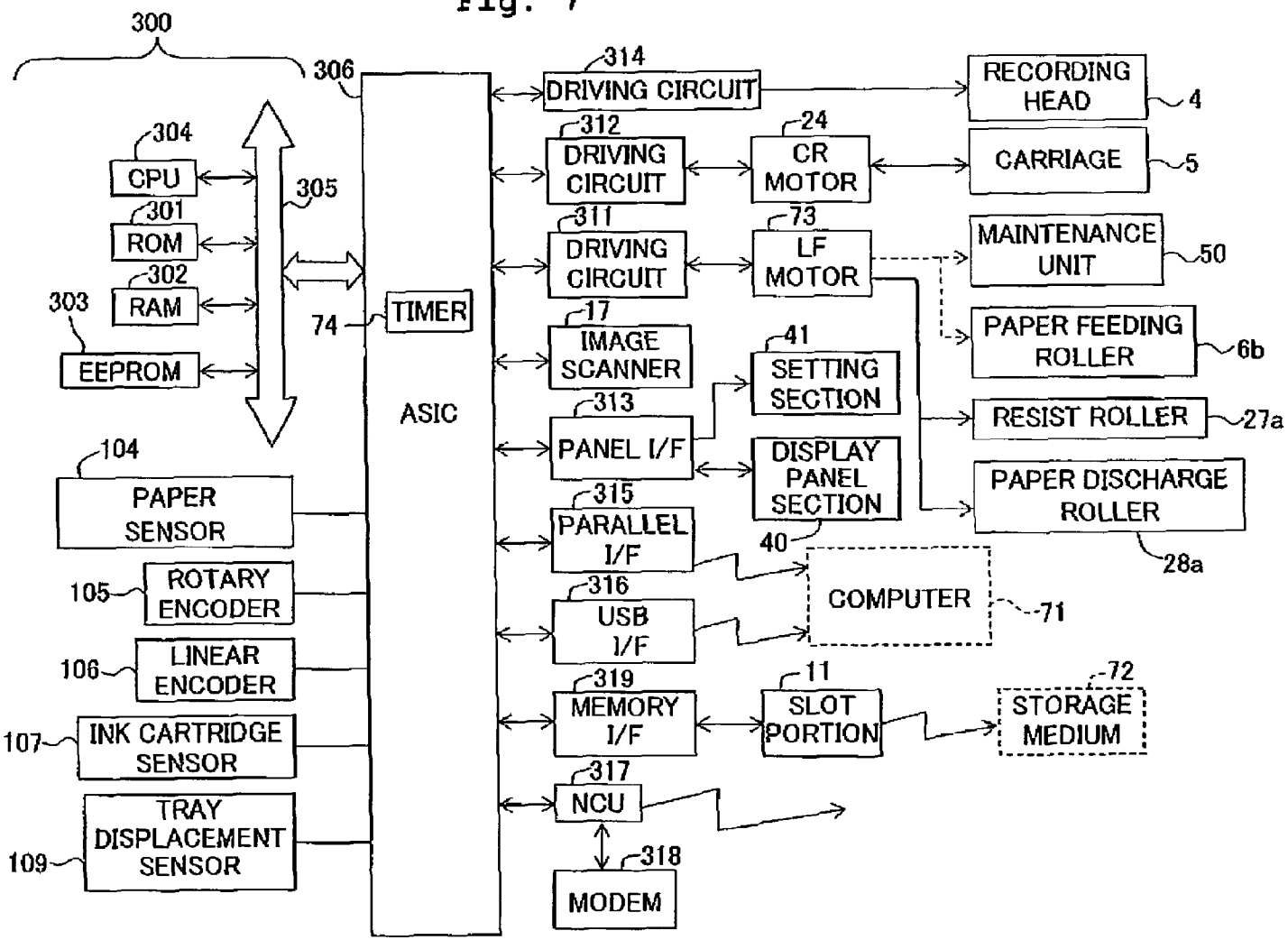
FIG. 7 is a block diagram showing a control system.

As shown in FIG. 7, the multi-function device 1 is connectable to a computer 71 such as a personal computer and a telephone line. The multi-function device 1 is also connectable to a storage medium 72. The multi-function device 1 is capable of recording an image on a recording medium such as a paper, based on image data which is received from the computer 71, other facsimile apparatus, and the storage medium 72. In the present patent application, the term 'image' includes a photo and a document. Moreover, the multi-function device 1 may be connected to a personal computer, a storage medium, and other facsimile by a wireless communication such as an infra-red ray communication, wireless LAN, and a Blue tooth.

Figure 1:
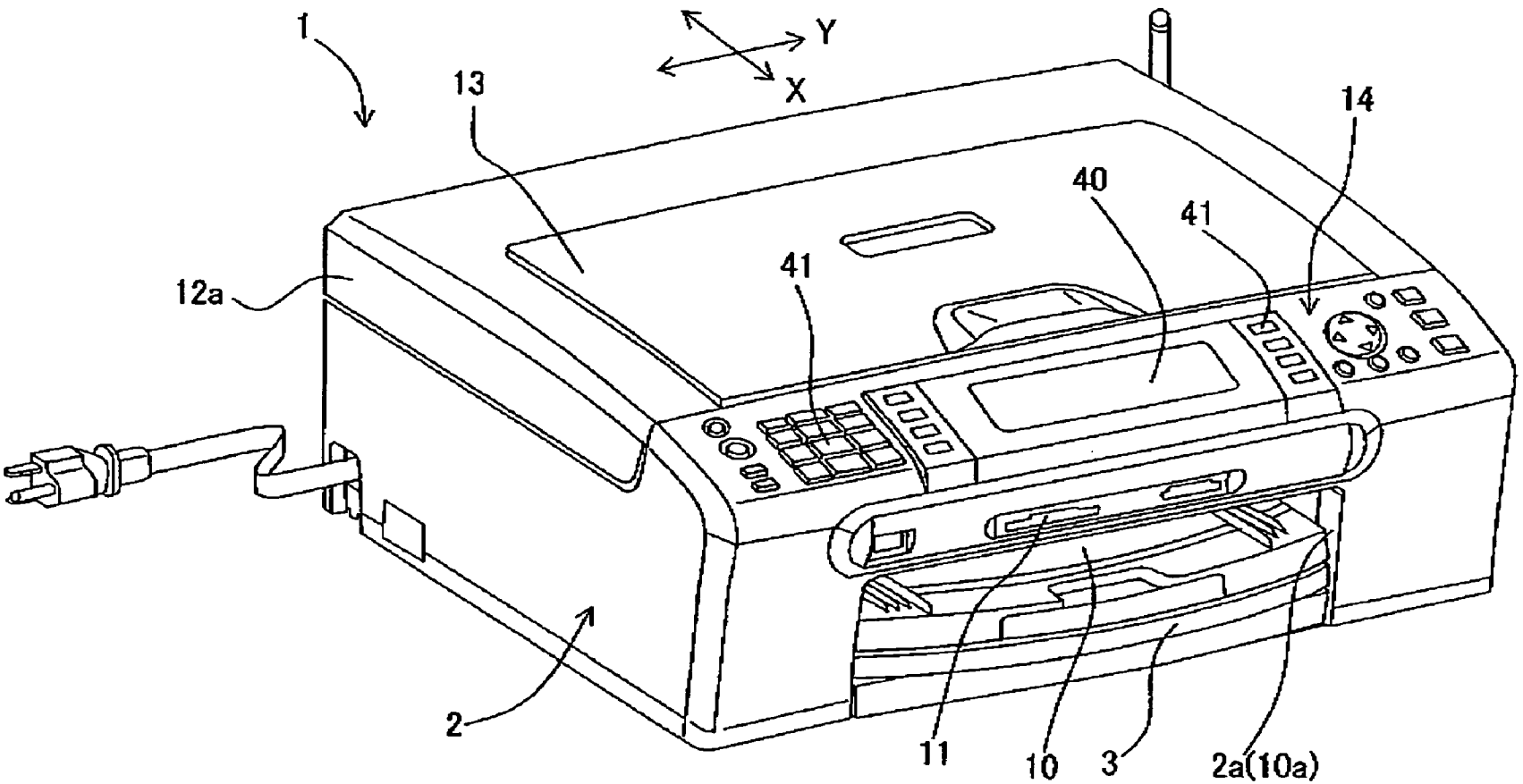
FIG. 1 is a perspective view of a multi-function device to which the present invention is applied.

As shown in FIG. 1, a recording section (recording head) 7 is provided on a lower portion of a main-body case (housing) 2 which is a casing of a main body of the multi-function device 1. A paper feeding cassette unit (paper feeding tray) 3 is inserted into an insertion opening (loading slot) 2*a* which opens on a front side of the housing 2. The paper feeding cassette unit 3, practically, is provided to be inserted and extracted horizontally, in a storage space at a bottom portion of the housing 2. In the following description, a side of the housing 2 where the insertion opening 2*a* is located is let to be a front (front face), and the opposite side thereof is let to be a rear (inside), and left and right facing the front face are defined as left side and right side.

A slot portion 11 is provided on a front-surface of the housing. A plurality of types of storage media 72 (refer to FIG. 7), in which data such as image data and control data for controlling the image recording is recorded, can be installed in the slot portion 11. The multi-function device 1 is also capable of recording the image, based on the image data recorded in the storage medium 72, directly on a paper without sending the image data from a personal computer.

As a recording medium installable in the slot portion 11, various recording media such as a semiconductor memory card are available in the market. As shown in FIG. 1, the slot portion 11 has slots of three different sizes, and is capable of dealing with various sizes of recording media. As it is shown in FIG. 7, a control section (controller) 300, including a CPU 304 which will be described later, detects a presence or an absence of the storage medium 72 which is installed in the slot portion 11. In other words, the control section 300 also serves as a detecting mechanism which detects the presence or the absence of the storage medium 72 installed in the slot portion 11.

In a case of image reading section (a image reading section case 12*a*) at an upper portion of the housing 2, an image reading unit (scanner section) 12, which reads a document in a copy operation and a facsimile operation, is arranged.

At an upper side of the housing 2, on a front side of the image reading unit 12, an operating section 14 which carries out various operations and displays is provided. Moreover, a recording section 7 and a paper discharge tray 10 are arranged to overlap, in a plan view, with the image reading unit 12 and the operating section 14.

Figure 3:
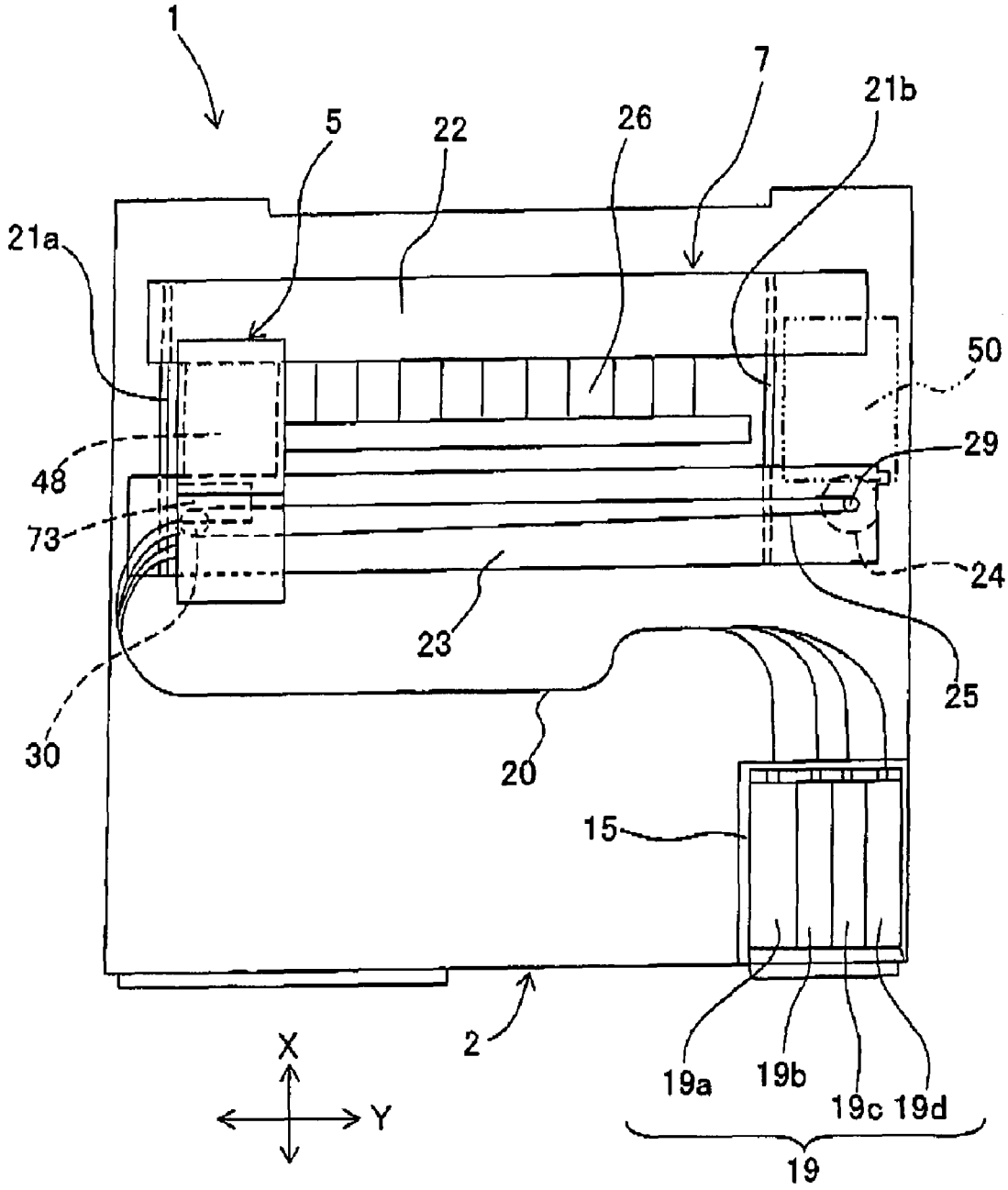
FIG. 3 is a schematic plan view describing a structure of a recording section.

An accommodating section (storage section) 15 of an ink cartridge 19 is provided next to the paper discharge tray 10 (right side in FIG. 1 and FIG. 3), on a front side of the housing 2. The ink cartridge 19 includes four individual ink cartridges 19*a*, 19*b*, 19*c*, and 19*d* (19*a* to 19*d*), in which inks of yellow, magenta, cyan, and black colors are stored respectively. The ink in each of the ink cartridges 19*a* to 19*d* is supplied to the recording head 4 independently, via an ink supply tube 20 which is flexible.

Figure 2:
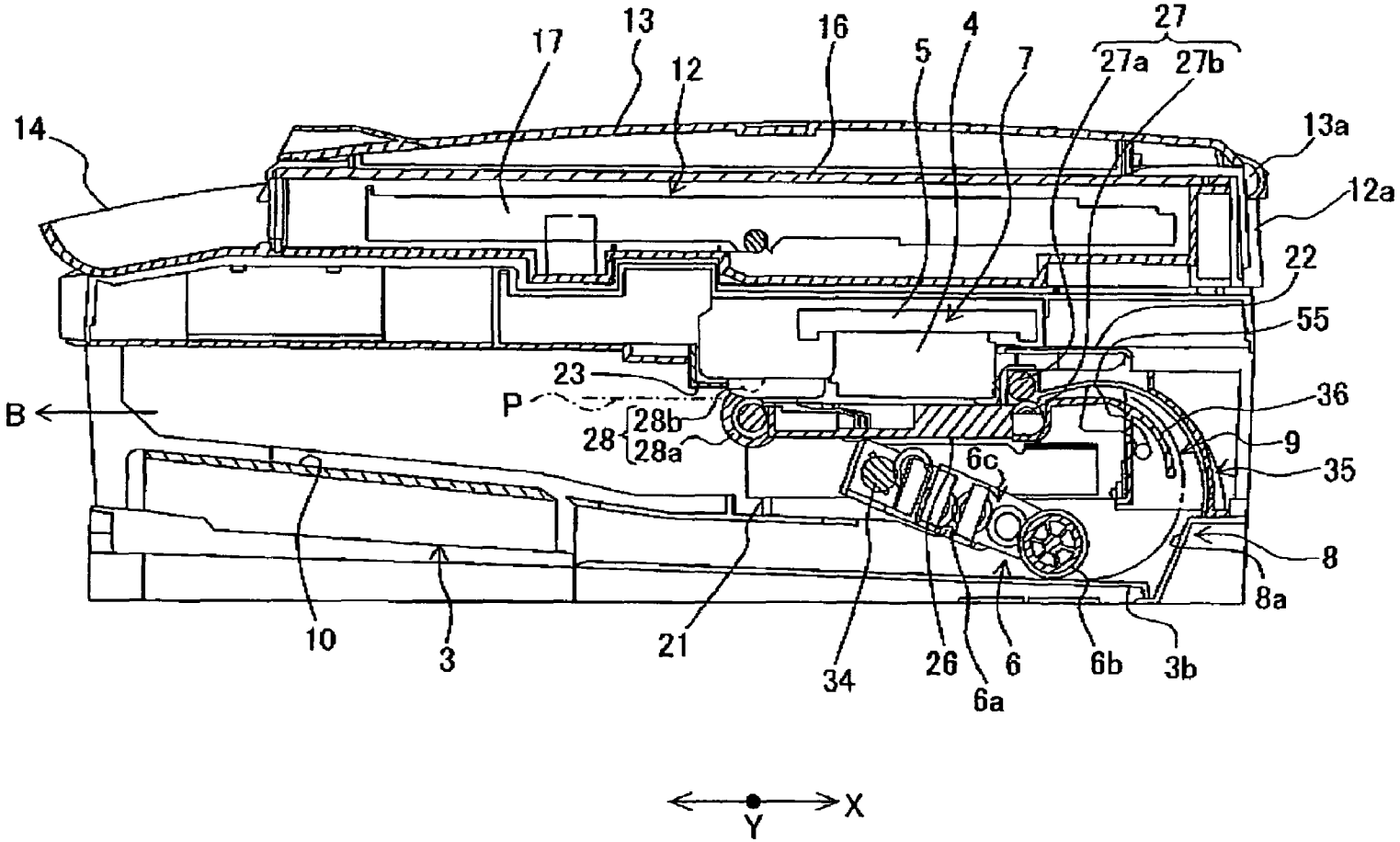
FIG. 2 is a side cross-sectional view of the multi-function device.

A glass plate 16 on which a document is placed is provided on an upper surface of the image reading unit 12, and an image scanner unit 17 which reads the document is provided, on a lower side thereof, to be reciprocatable in a direction orthogonal to a paper surface in FIG. 2 (scanning direction of a carriage 5, Y axis direction). A hinge 13*a* is provided on a rear-end side (right side in FIG. 3) of a document cover 13 which covers the glass plate 16 for placing a document, and the document cover 13 is openably fixed to the image reading section case 12*a*.

As shown in FIG. 2, the recording section 7 is provided in a main frame of which an upper side is open, and includes components having various functions. The main frame 21 includes a pair of side plates 21*a*, 21*b* on a left and right side, and a first guide member 22 and a second guide member 23, the first and second guide member 22, 23 being plate members supported by the side plates and being extended in the Y axis direction (main scanning direction). The carriage 5 is slidably supported by the first guide member 22 and the second guide member 23, and the carriage 5 is arranged to bridge between the first and second guide members 22 and 23. A platen 26 which supports the paper is arranged to face a lower-surface of the recording head 4 mounted on the carriage 5.

The carriage 5 is attached to a timing belt 25 which is wound over pulleys 29 and 30, on an upper surface of the second guide member 23, and is reciprocated by driving the pulley 29 by a CR (carriage) motor 24.

Next, a feeding mechanism which feed a paper to the recording head 4 and a discharging mechanism which discharge the paper from the recording head 4 will be described below. Firstly, a resist roller pair 27 which has both a transporting function and a resisting function is arranged in the platen 26 on an upstream side in a direction of transportation. The resist roller pair 27 includes a driving resist roller 27*a* and a driven resist roller 27*b*. That is, the driving resist roller 27*a* is rotated actively and the driven resist roller 27*b* is rotated passively. The resist roller pair 27 transports a paper to a gap between the platen 26 and a nozzle surface on a lower surface of the recording head 4. A discharge roller pair 28 is arranged on a downstream side of the platen 26, and includes a spur 28*b* which makes a contact with an upper surface of the paper, and a paper discharge roller for driving (driving paper-discharge roller) 28*a* which makes a contact with a lower surface. The discharge roller pair 28 transports the paper with a recording carried out thereon, to the paper discharge tray 10.

On an inner side (rear-end side, right side in FIG. 2) of the paper feeding cassette unit 3, an inclined plate 8 having an elastic separating pad 8*a* for separating papers is arranged. A paper feeding roller 6*b* provided at a lower end of a paper feeding arm 6*a* rotates via a gear transmission mechanism 6*c* from a drive shaft 34. By this rotation, papers stacked in the paper feeding cassette unit 3 are transported one by one.

The paper which is transported is fed to the resist roller pair 27 via a U-turn path (paper feeding transporting path) 9, formed between a U-shaped outer-side transportation path 35 and an inner-side transportation path 36. The paper with the recording carried out thereon in the recording section 7 is discharged to the paper discharge tray 10, with a recording surface facing upward. The paper discharge tray 10 is provided at an upper side of the paper feeding cassette unit 3. A paper discharge opening 10*a* (upper portion of the insertion opening 2*a*, refer to FIG. 1) which communicates with the paper discharge tray 10 is formed to open in a front surface of the housing 2.

On a downstream side of the paper feeding transporting path (U-turn path) 9, a detection lever 55 which detects passing of a front-end edge and a rear-end edge of a paper passing through the paper feeding transporting path (U-turn path) 9, is provided. As shown in FIG. 2, the detection lever 55 is rotatably provided, intersecting the paper feeding transporting path 9 horizontally.

Moreover, when papers in the paper feeding cassette unit 3 are to be replenished or replaced, the paper feeding cassette unit 3 is pulled integrally with the paper discharge tray 10, to a front side of the housing 2. A displacement of the paper feeding cassette unit 3 with respect to the housing 2 is detected by a tray displacement sensor 109 (refer to FIG. 7) which is built-in near the paper feeding cassette unit 3 of the housing 2. A contact (pressure) sensor or an optical sensor is suitable as the tray displacement sensor 109.

Figure 5:
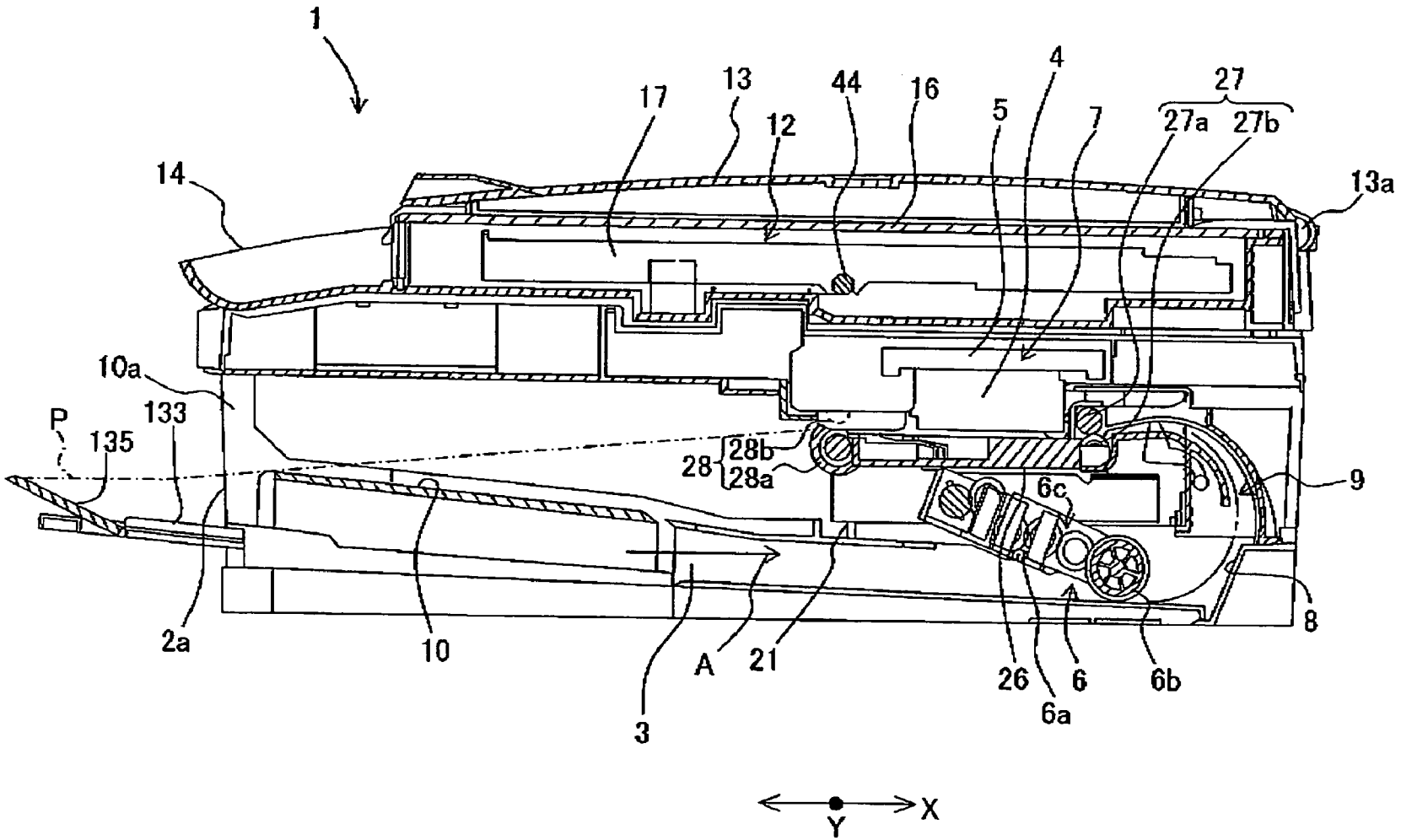
FIG. 5 is a diagram corresponding to FIG. 2 showing another example of a paper discharge tray.
Figure 6:
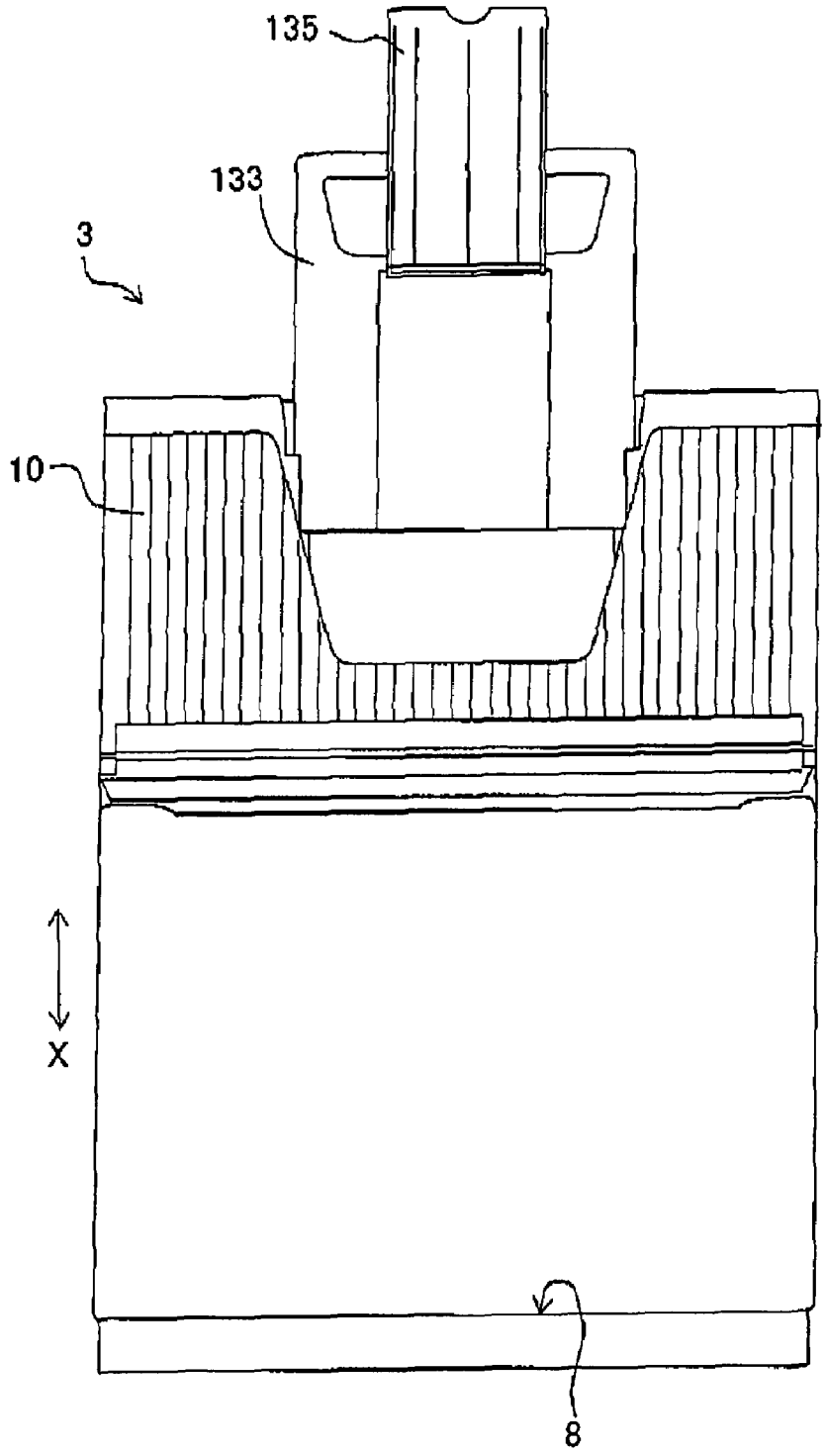
FIG. 6 is a plan view showing another example of the paper discharge tray.

The paper discharge tray 10 shown in FIG. 2 does not move (is not displaced) independently, but, as another mode of the paper discharge tray 10, a part of the paper discharge tray 10 may be displaceable, as shown in FIGS. 5 and 6. In the multi-function device 1 shown in FIGS. 5 and 6, the paper discharge tray 10 is partially overlapped with an outer-side end portion (upstream-side end portion in a direction of transportation of paper) of the paper feeding cassette unit 3, having a gap between a lower surface of the paper discharge tray 10 and an upper surface of the paper feeding cassette unit 3. On the outer-side end portion of the paper feeding cassette unit 3, an auxiliary supporting member 133 which is extended to be sliding further outward, and an auxiliary paper discharge tray 135 is foldably rotatable from the auxiliary supporting member 133, and of which an outer side is kept to be highly inclined, are provided. It is possible to attach and detach the paper feeding cassette unit 3 and the paper discharge tray 10 integrally, to and from the main-body frame 2.

Consequently, it is possible to close the insertion opening by pushing the auxiliary supporting member 133 inside the main-body frame 2, and rotating in a direction of erecting the auxiliary paper discharge tray 135. Moreover, when the auxiliary supporting member 133 is pulled and the auxiliary paper discharge tray 135 is opened, an area of the paper discharge tray 10 becomes wide. In such mode, the tray displacement censor 109 may include a sensor which detects sliding of the auxiliary supporting member 133 and the rotation (turning) of the auxiliary paper discharge tray 135.

Moreover, it is not shown in the diagram, but at the time of using the paper discharge tray 10 for example, when the entire paper discharge tray 10 is displaced with respect to the paper feeding cassette unit 3, the tray displacement sensor 109 may include a sensor which detects the displacement of the paper discharge tray 10. Moreover, when an openable lid is provided to the insertion opening 2*a* of the paper discharge tray 10, the tray displacement sensor 109 may include a sensor which detects that the lid is open.

At one side in a width direction of the transported paper (position near the side plate 21a on a left side in FIG. 3 in the embodiment), an ink receiving section (an ink-receiver) 48 is arranged, and on the other side (position near the side plate 21*b* on a right side in FIG. 3) a maintenance unit 50 is arranged.

The ink receiving section 48 is provided corresponding to a flushing position of the carriage 5. The recording head 4 periodically carries out ink jetting (flushing) for preventing blocking of nozzles during a recording operation at the flushing position. The jetted ink is received in the ink receiving section 48.

Figure 4:
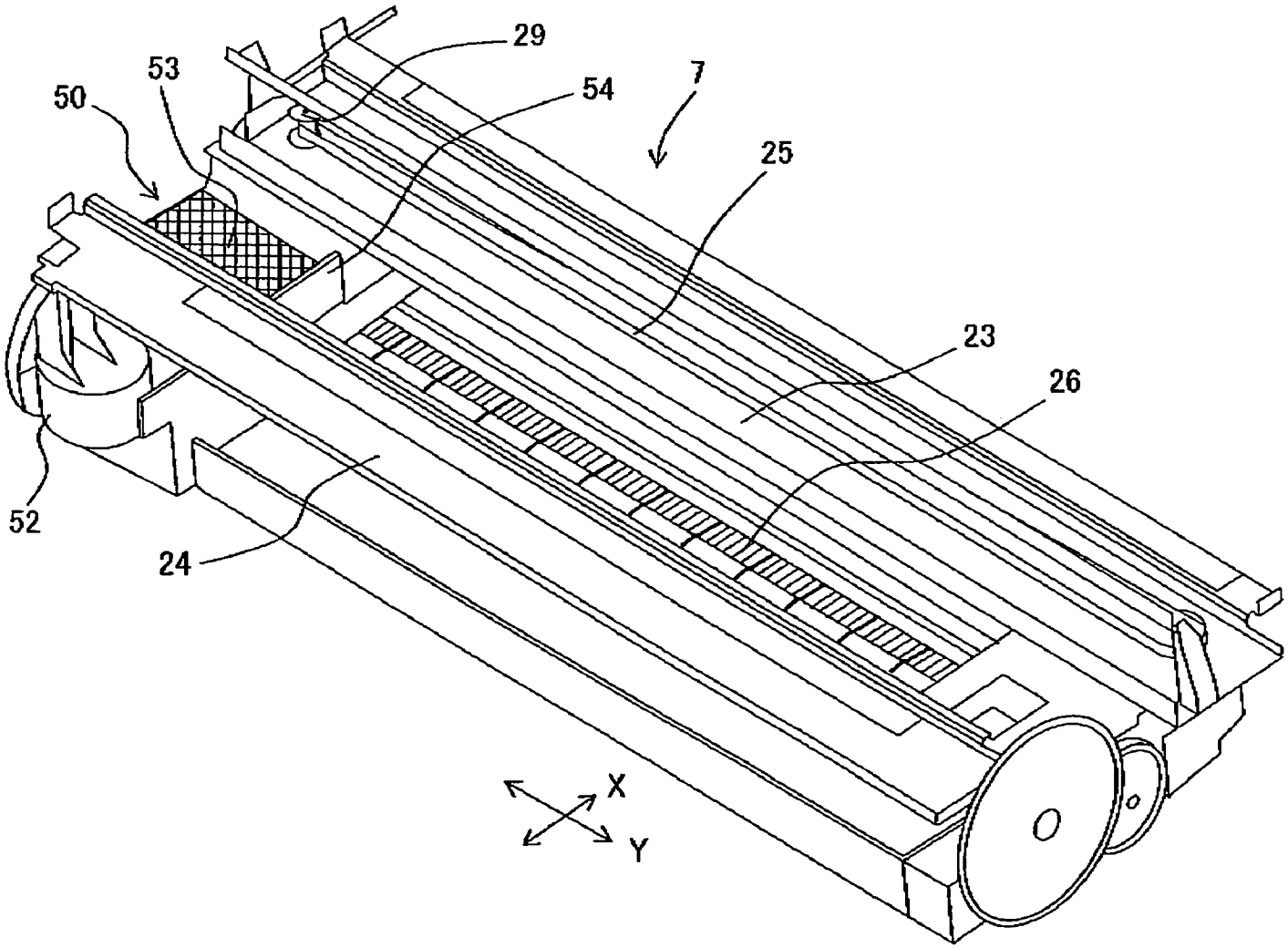
FIG. 4 is a perspective view of the recording section as viewed from a rear-surface side.

The maintenance unit 50 is provided corresponding to a standby position (home position) of the carriage 5, and carries out a suction recovery operation (purging) of the recording head 4. As shown in FIG. 4, the maintenance unit 50 is provided with a cap 53, which is connected to a pump 52 arranged on the main-body frame 2, and a wiper 54 which wipes off the nozzle surface.

In the recovery operation, a plurality of operations is carried out independently or in combination. Firstly, the nozzle surface of the recording head 4 is covered by the cap 53, and sucks dry ink (thickened ink) and air bubbles in the ink from the nozzles of the recording head 4. Moreover, the cap 53 is separated from the nozzle surface, and the carriage 5 is moved from a portion of the maintenance unit 50 in a direction of image recording area. At this time, the cleaning of the nozzle surface of the recording head 4 is carried out by the wiper 54. Furthermore, the flushing, that is, moving the carriage 5 to the flushing position and carrying out ink jetting toward the ink receiving section 4B from the nozzles by driving the recording head 4 irrespective of the recording operation, is also included in the recovery operation.

As described later, a degree of the recovery operation is set such that a degree of the recovery operation is changed according to conditions such as a time elapsed after carrying out the previous recovery operation. Here, an operation of covering the recording head 4 by the cap 53, and separating the cap by suction by the pump 52 is identified as a series of recovery operations, and by changing the number of times for which the series of recovery operations is repeated, in other words, by changing a frequency of suction by the pump 52, the degree of the recovery operation is changed. Moreover, it is also possible to change the degree of the recovery operation by controlling a length of a suction time of the pump 52 and/or a magnitude of a suction force of the pump 52.

An LF motor 73 (refer to FIG. 3 and FIG. 6) for paper transporting is a drive source of a drive of the pump 52 of the maintenance unit 50, and a movement of the cap 53 and the wiper 54 with respect to the nozzle surface. In addition to the maintenance unit 50, it is also possible to drive the paper feeding roller 6*b* of a paper feeding mechanism 6, the resist roller for driving 27*a*, and the paper discharge roller 28*a* by switching the direction of rotation of the LF motor 73.

Next, the operating section 14 will be described below. The operating section 14 has a substantially same width as a horizontal width of the multi-function device 1, and is provided at a front side upper portion of the housing 2. The operating section 14, as a whole, is arranged to be inclined with a front side inclined downward, such that it is easy for a user to use. A display panel section 40 of a liquid crystal screen is arranged at a central portion of the operating section 14. A rear-end side of the display panel section 40 can be turned up and down by a hinge which is provided on a front-end side. In other words, an angle of the display panel section 40 can be adjusted such that it is easy for the user to see.

On both sides sandwiching the display panel section 40 of the operating section 14, a setting section 41 which includes a plurality of buttons and a numerical key pad etc. it arranged. The users can select and set various functions (operations) provided in the multi-function device 1 by using the setting section 41. Function keys 'FAX', 'SCAN', 'COPY', and 'DIGITAL CAMERA PRINT' on which functions are indicated are arranged in the setting section 41. It is possible to select and execute any of a facsimile function, a scan function, a copy function, and a function of printing image data of a recording medium inserted by pressing the function key. In addition, a button for commanding the recovery operation of the recording head 4 is also provided. Moreover, an image scroll button and a button for selecting are also included in the setting section 41, and it is also possible to command an operation by selecting and setting items displayed on the screen of the display panel section 40.

Next, the control section 300 of the image recording apparatus 1 will be described with reference to FIG. 7. The control section 300 controls an overall operation of the image recording apparatus 1.

The control section 300 (controller and detecting mechanism) has mainly a microcomputer which includes the CPU 304, a Read Only Memory (ROM) 301, a Random Access Memory (RAM) 302, and an Electrically Erasable and Programmable Read Only Memory (EEPROM) 303, and an Application Specific Integrated Circuit (ASIC) 306 which is connected to the CPU 304, the ROM 301, the RAM 302, and the EEPROM 303, via a bus 305. The ASIC 306 or the microcomputer includes a timer 74 (clock mechanism) which measures a time T elapsed after the recovery operation is executed previously by the maintenance unit 50 described above.

Computer programs which control various operations of the multi-function device 1 are stored in the ROM 301. RAM 302 is used as a storage area which temporarily stores various data when the CPU 304 executes these computer programs, and is also used as a working area.

A network control unit (NCU) 317 is connected to the ASIC 306, and a communication signal which is input from a public line (Public Switched Telephone Network (PSTN)) via the NCU 17 is input to the ASIC 306 after being demodulated by a modem 318. Moreover, when the ASIC 306 transmits image data by facsimile transmission etc., that image data is modulated to a communication signal by the modem 318, and the communication signal is output to the public line via the NCU 317.

Moreover, the ASIC 306 follows a command from the microcomputer, and generates phase excitation signals to be passed to each motor for example. The ASIC 306 imparts these phase excitation signals to a driving circuit 311 of the LF motor 73 and a driving circuit 312 of the CR motor 24, and controls the LF motor 73 and the CR motor 24.

Furthermore, the image scanner unit 17, a panel interface 313, a parallel interface 315, a USE interface 316, and a memory interface 319 are connected to the ASIC 306. The image scanner unit 17 is used for reading a document. The panel interface 313 includes the setting section 41 and the display panel section 40 for various operations. The parallel interface 315 and the USB interface 316 are for transmitting and receiving data to and from an external equipment such as the personal computer 71 via a parallel cable and a USB cable. The memory interface 319 includes a slot portion 11 which is an external input terminal in which the storage medium 72 is inserted.

Furthermore, a plurality of sensors such as a paper sensor 104, a rotary encoder 105, a linear encoder 106, an ink cartridge sensor 107, and a tray displacement sensor 109 are connected to the ASIC 306 (refer to FIG. 6). The paper sensor 104 is provided in association with a detection lever 55 (refer to FIG. 2) which is provided on the downstream side of transportation of the paper feeding transporting path 9. The rotary encoder 105 detects an amount of rotations of the resist roller 27. The linear encoder 106 detects an amount of movement of the carriage 5. The ink cartridge sensor 107 detects that the ink cartridge 19 has been replaced. The tray displacement sensor 109 detects that one of the paper feeding cassette unit 3 and the paper discharge tray 10 is displaced.

A driving circuit 314 drives the recording head 4, and makes jet selectively the ink from the recording head 4 on to a paper at a predetermined timing. The driving circuit 314 receives a signal which is generated in, and output from the ASIC 306 based on a drive control command, and carries out a drive control of the recording head 4.

Next, contents of the recovery operation stored in the ROM 301 will be described below. A table shown in FIG. 8 is stored in the ROM 301. Concrete numerical values shown in the table are mere examples, and it is possible to change these numerical values appropriately according to the structure of the recording head 4 and the maintenance unit 50, and a capacity of the pump.

T is a time (count value) measured by the timer 74 which is a time after the previous recovery operation was executed. A 'number of purging' (purging frequency) shown in the table is the number of times for which a series of recovery operations of covering the recording head 4 by the cap body and sucking by the pump, is repeated.

In the embodiment, when the time T after the previous recovery operation is executed is more than five days but not more than 10 days, the purging frequency is set to be 'once', when the Time T is more than 10 days but not more than 15 days, the purging frequency is set to be 'twice', and when the time T is more than 15 days, the purging frequency is set to be 'three times'. Moreover, for the recovery operation which is carried out upon being specified by the user (normal purging), the purging frequency is set to be 'once'. An arrangement may be made such that the flushing is carried out for jetting the ink from the recording head 4, instead of the recovery operation by the pump, or in continuation with the recovery operation by the pump, irrespective of the recording operation.

Next, a control related to the recovery operation of the multi-function device 1 (a control program of the micro computer) will be described by using flowcharts in FIGS. 9 and 10.

While the multi-function device 1 is in a standby state in which no operation is performed, when a change occurred in a position of the paper feeding cassette unit 3 or the paper discharge tray 10 is detected (Yes at step S101), this change in the position is judged to be a precursor of execution of the recording operation in the recording section 7, and the process shifts to a subroutine S102 (step S102) of a first recovery process. In the recovery process (refer to FIG. 10) which will be described later, a judgment of whether or not the recovery operation for the recording head 4 is necessary is made. Thereafter the recovery operation is carried out when necessary, and the process returns to a main routine shown in FIG. 9.

In other words, since the paper feeding cassette unit 3 is disengaged from the main-body frame 2 at the time of replenishing and replacing the papers, the disengaging of the paper feeding cassette unit 3 is detected by the tray displacement sensor 109. Generally, since the replenishing or replacing of papers is carried out as an operation prior to the command for the recording operation by the user, the detection by the tray displacement sensor 109 can be judged to be a precursor of the recording operation.

For instance, as shown in FIG. 5 and FIG. 6, when the paper discharge tray 10 is provided with the auxiliary supporting member 133 and/or the auxiliary paper discharge tray 135, an operation of sliding the auxiliary supporting member 133 and an operation of turning the auxiliary paper discharge tray 135 by the user are considered as operations for receiving the recorded papers in the paper discharge tray 10. Consequently, detecting the change (displacement) of the paper discharge tray 10 by the tray displacement sensor 109 can be used for judgment as one of the changes prior to the recording operation.

Even in a case in which no change occurs in the paper feeding cassette unit 3 and the paper discharge tray 10 (No at step S101), when the recovery operation is commanded by the user by pressing a specific button for the recovery operation (Yes at step S103), the process moves to a subroutine S104 (step S104) of a second recovery process. In this case, after carrying out the recovery process forcibly, the process returns to the main routine. Moreover, even when the recovery operation is not commanded by the user (No at step S103), when the recording operation is commanded by the user, or from an external equipment such as the personal computer 71 (Yes at step S105), the process shifts to a subroutine S106 (step S106) of a third recovery process. In this case, after carrying out the recovery operation according to the requirement, the recording operation is carried out (step S107).

Figure 9:
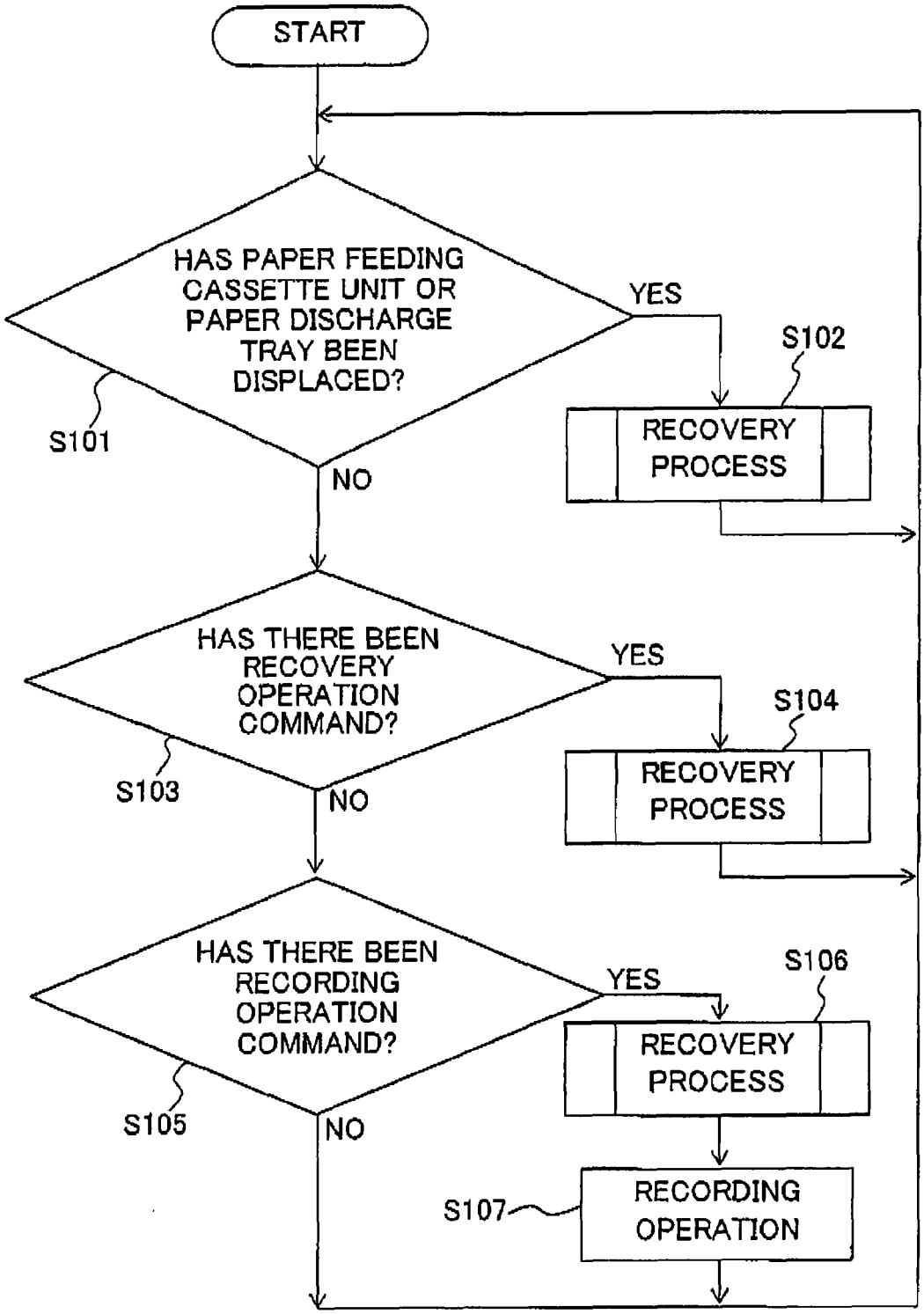
FIG. 9 is a flowchart showing a main routine of a recovery operation of the multi-function apparatus.
Figure 10:
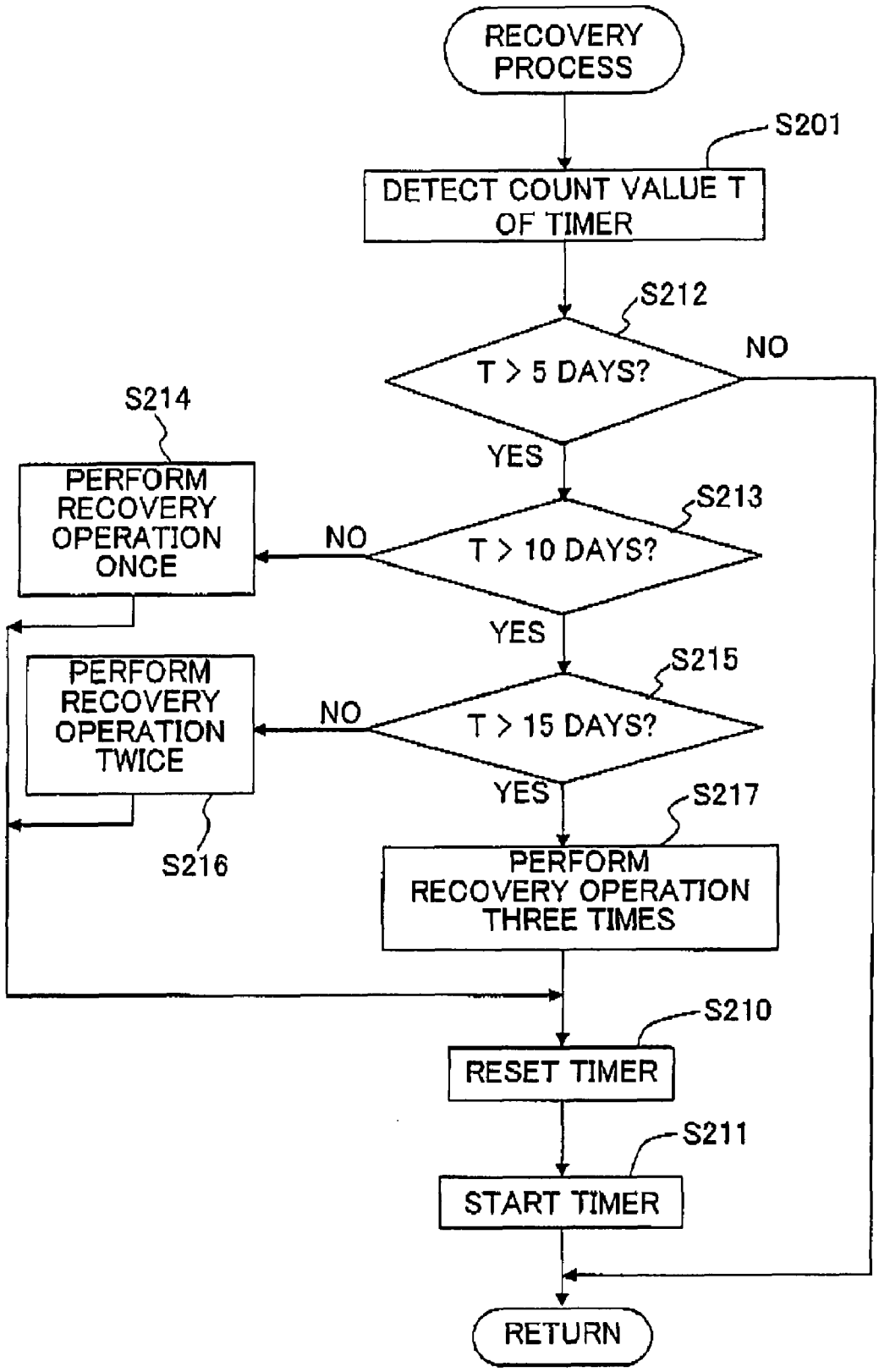
FIG. 10 is a flowchart of a recovery process.

As shown in FIG. 10, at subroutine steps S102 and S106 of the first recovery process and the third recovery process, firstly, the time T (count value) after the previous recovery operation is carried out, which is measured by the timer 74, is detected (step S201). A judgment of whether or not the count value T is more than five days is made (step S212). When the count value is not more than five days (No at step S212), the execution of the recovery operation is judged to be unnecessary, and this recovery process (operation) is terminated, and the process returns to the main routine in FIG. 9.

When the count value T is more than five days but not more than ten days (Yes at step S212 and No at step S213), the purging frequency 'once' is read from the table shown in FIG. 8, and the series of recovery operations is carried out once (step S214). When the count value T is more than 10 days but not more than 15 days (Yes at step S213 and No at step S215), the purging frequency 'twice' is read from the table, and the series of recovery operations is carried out twice (step S216). When the count value T is more than 15 days (No at step S216), the purging frequency 'three times' is read from the table, and the series of recovery operations is carried out three times (step S217).

When the recovery operation is completed (steps S214, S216, and S217), the count value T of the timer 74 is reset (step S211), and the process returns to the main routine in FIG. 9.

Moreover, since the subroutine S104 of the second recovery process is a process carried out forcibly by the user, the recovery operation is carried out only once without changing the control by the count value T as in FIG. 10. Thereafter, the count value of the timer 74 is reset, and the counting by the timer 74 is started again, and the process returns to the main routine in FIG. 9.

In this manner, when there occurs a displacement of the paper feeding cassette unit 3 or a displacement of the paper discharge tray 10 before the recording operation is commanded in the multi-function device 1, it is judged to be a precursor of the command for the recording operation, and immediately, a judgment of whether or not the multi-function device 1 is in a state in which the recovery operation is necessary (whether predetermined time has elapsed after the previous recovery operation) is made, and if necessary, the recovery operation is carried out. Thereafter, when a command is made for a recording operation of image data in the storage medium 74, or image data from the personal computer 71 etc., since the recording operation is already completed, or being executed, it is possible to shorten a time up to the termination of recording, and to eliminate the inconvenience for the user as compared to a case of carrying out the recovery operation after commanding the recording operation as in the conventional approach.

Moreover, since the degree of the recovery operation is changed according to the length of the time elapsed after the previous recovery operation, superfluous ink is not consumed at the recovery operation, and it is possible to recover assuredly the favorable state of the recording head.

The control, in which the process shifts to the recovery process when there has been a change in the paper feeding cassette unit 3 or the paper discharge tray 10 (step S101) shown in FIG. 9, may be switched between an active state and an inactive state in accordance with an ON/OFF switch.

In the embodiment described above, the paper feeding cassette unit is provided on the front face of the multi-function device. However, a cassette unit for paper feeding may be provided on a rear face of the multi-function device for example. Moreover, a bypass tray (manual paper feeding tray) may be provided to the multi-function device. For example, when the bypass tray is foldable (collapsible), a sensor which detects a position of the bypass tray may be provided, and the abovementioned control may be carried out. In other words, it is possible to have an arbitrary structure and arrangement of the paper feeding mechanism for feeding the paper, and the paper discharge mechanism for discharging the paper, and when there is a movable portion in the paper feeding mechanism and the paper discharge mechanism, a sensor which detects a displacement thereof may be provided, and based on a detection signal from the sensor, the abovementioned control may be carried out.

In the embodiment described above, a semiconductor memory has been exemplified as a storage medium. However, the storage memory for reading data such as an image is not restricted to the semiconductor memory. A reading mechanism of an optical storage medium such as a CD-ROM and a DVD-ROM may be provided, or a reading mechanism of a magneto-optical recording medium such as an FD and an MO may be provided. Or, the reading mechanism may be connected via an appropriate interface. Moreover, in the embodiment described above, a multi-function device has been exemplified as an image recording apparatus. However, the image recording apparatus is not necessarily required to have functions such as a copy function, a facsimile function, and a scanner function, and may have only a printer function.

What is claimed is:

1. An image recording apparatus which forms an image by jetting an ink onto a recording medium from nozzles, comprising:

a recording head which includes a nozzle surface having the nozzles formed therein, and which records the image based on a recording command by jetting the ink from the nozzles onto the recording medium;

a paper feeding mechanism which feeds the recording medium to the recording head;

a paper discharge mechanism which discharges the recording medium from the recording head;

a recovery mechanism which performs a recovery operation for recovering a jetting state of the nozzles;

a timer which measures an elapsed time elapsed after the recovery mechanism has performed the recovery operation;

a detecting mechanism which detects a change occurred in the paper feeding mechanism or the paper discharge mechanism; and a controller which controls the recovery mechanism to perform the recovery operation when the detecting mechanism detects the change and when the elapsed time measured by the timer exceeds a predetermined time.

2. The image recording apparatus according to claim 1, wherein the paper feeding mechanism includes a paper feeding tray on which the recording medium to be fed to the recording head is placed, and the detecting mechanism includes a first sensor which detects a change in a position of the paper feeding tray.

3. The image recording apparatus according to claim 1, wherein the discharge mechanism includes a paper discharge tray on which the recording medium discharged from the recording head is placed, and the detecting mechanism includes a second sensor which detects a change in a position of the paper discharge tray.

4. The image recording apparatus according to claim 1, wherein the controller controls the recovery mechanism to change a degree of the recovery operation depending on a length of the elapsed time measured by the timer.

5. The image recording apparatus according to claim 4, wherein the controller controls the recovery mechanism such that the recovery mechanism performs the recovery operation once when the elapsed time is more than five days but not more than 10 days, that the recovery mechanism performs the recovery operation twice when the elapsed time is more than 10 days but not more than 15 days, and that the recovery mechanism performs the recovery operation three times when the elapsed time is more than 15 days.

6. The image recording apparatus according to claim 1, further comprising a reading mechanism which reads a predetermined image formed on an original document.

7. The image recording apparatus according to claim 1, further comprising a storage-medium reading mechanism which reads data from a storage medium in which a predetermined data is stored.

8. The image recording apparatus according to claim 1, wherein the recovery mechanism includes a cap which covers the nozzle surface, a pump which is connected to the cap and which decompresses a space defined by the cap and the nozzle surface, and a wiper which wipes the nozzle surface.

9. A method for recovering a recording head of an image recording apparatus which includes the recording head, a paper feeding mechanism which feeds a recording medium to the recording head and a paper discharge mechanism which discharges the recording medium from the recording head, the method comprising:

measuring an elapsed time elapsed after the recording head has been recovered;

detecting a change occurred in the paper feeding mechanism or the paper discharge mechanism; and recovering the recording head when the change is detected and when the elapsed time exceeds a predetermined time.

10. The method for recovering the recording head according to claim 9, wherein the paper feeding mechanism includes a paper feeding tray on which the recording medium to be fed to the recording head is placed, and the change occurred in the paper feeding mechanism is a change in a position of the paper feeding tray.

11. The method for recovering the recording head according to claim 9, wherein the discharge mechanism includes a paper discharge tray on which the recording medium discharged from the recording head is placed, and the change occurred in the paper discharge mechanism is a change in a position of the paper discharge tray.

12. The method for recovering the recording head according to claim 9, wherein a degree of the recovering of the recording head is changed depending on a length of the elapsed time.

13. The method for recovering the recording head according to claim 9, wherein the recovering of the recording head is performed once when the elapsed time is more than five days but not more than 10 days, the recovering of the recording head is performed twice when the elapsed time is more than 10 days but not more than 15 days, and the recovering of the recording head is performed three times when the elapsed time is more than 15 days.

* * * * *